United States Patent [19]

Asselman et al.

[11] 4,126,995

[45] Nov. 28, 1978

[54] HOT-GAS ENGINE WITH PROTECTED HEAT RESERVOIR

[75] Inventors: George A. A. Asselman; Herman Fokker; Roelf J. Meijer, all of Eindhoven, Netherlands

[73] Assignee: U.S. Philips Corporation, New York, N.Y.

[21] Appl. No.: 802,906

[22] Filed: Jun. 2, 1977

[30] Foreign Application Priority Data

Jun. 11, 1976 [NL] Netherlands ..... 7606301

[51] Int. Cl.[2] ..... F02G 1/04

[52] U.S. Cl. ..... 60/524; 60/659; 165/104 S

[58] Field of Search ..... 165/104 S; 60/517, 524, 60/525, 526, 659

[56] References Cited

U.S. PATENT DOCUMENTS

| | | | |
|---|---|---|---|
| 2,933,885 | 4/1960 | Benedek | 60/659 |
| 3,029,596 | 4/1962 | Hanold | 60/524 |
| 3,080,706 | 3/1963 | Flynn | 60/659 |
| 3,845,625 | 11/1974 | Schroder | 60/524 |
| 3,848,416 | 11/1974 | Bundy | 60/659 X |
| 3,863,452 | 2/1975 | Asselman | 60/524 |

*Primary Examiner*—Allen M. Ostrager
*Attorney, Agent, or Firm*—David R. Treacy

[57] ABSTRACT

A hot-gas engine in which the transfer of heat from the heat-source to the meltable material of a heat storage reservoir is effected exclusively indirectly via the working medium in order to prevent overheating, fast corrosion and cracking of the reservoir walls.

9 Claims, 6 Drawing Figures

HOT-GAS ENGINE WITH PROTECTED HEAT RESERVOIR

BACKGROUND OF THE INVENTION

The invention relates to a hot-gas engine, having at least one closed working space in which a working medium performs a thermodynamic cycle during operation, and arranged so that heat originating from a heat source is supplied to the said working medium via a heater having one or more ducts through which working medium flows during operation, and more particularly to a hot-gas engine which also includes one or more reservoirs containing a meltable material which stores heat originating from the heat source.

A hot-gas engine of this kind is known from Swiss patent specification No. 512,670, to which U.S. Pat. No. 3,791,136 corresponds.

In the known hot-gas engine, the flue gases originating from a burner device give off part of their heat directly to the working medium by flowing past heater pipes or ducts through which working medium flows, and part of their heat directly to the meltable heat-storing material in the reservoir where the flue gases flow along wall portions of this reservoir.

However, direct heating of the meltable heat-storing material in the reservoir by the flue gases can introduce some problems.

Because the meltable material, usually a salt such as LiF, $CaF_2$, $SrF_2$ or a mixture of salts, has a low heat conductivity in the molten as well as in the solid state, the reservoir walls along which the hot flue gases flow assume a very high temperature. This causes fast corrosion of these reservoir walls, on the flue gas side as well as on the side of the storage material, which normally contains impurities having a corrosive effect.

The risk of burning through and/or cracking of the reservoir walls is high, particularly when such salts are in the solidified state. This is because the usable salts shrink substantially upon solidification (volume reduction in the order of magnitude of 30%), so that the contact between the salt and the reservoir walls is substantially broken and the wall portions heated by the flue gases are not cooled by direct conduction.

The choice of thick reservoir walls is not attractive in view of the weight and the dimensions of the engine and, moreover, it does not offer a satisfactory solution to the problem of fast corrosion. Maintaining a maximum flue gas temperature which is substantially higher than the melting temperature of the salt but lower than the temperature limit imposed for the material of the reservoir walls constitutes a difficult control problem for the hot-gas engine with its variable load. The temperature fluctuations in the flue gases would then have to be limited to plus or minus 50° C.

SUMMARY OF THE INVENTION

The object is to provide a hot-gas engine of the described kind in which the walls of the heat-storage reservoir may be comparatively thin and are subject to corrosion to only a limited degree, without risk of burning through or cracking.

In accordance with the invention the reservoir of a hot-gas engine is arranged so that heat is transferred from the heat source to the meltable heat-storing material exclusively indirectly via the working medium.

Thus the material in the reservoir receives heat exclusively by direct exchange with a medium which has a substantially lower temperature than the heat source. No additional facilities are required for controlling the working medium temperature, because adequate control is already known (see, for example, U.S. Pat. No. 3,780,528 and 3,782,120).

In a preferred embodiment of the hot-gas engine in which the heater duct is arranged partly inside at least one reservoir and is partly in direct thermal contact with the heat source, as known from U.S. Pat. No. 3,791,136, according to the invention the reservoir is thermally insulated relative to the heat source.

An alternative preferred embodiment of the invention is characterized in that the reservoir is arranged inside the heater duct or one of the heater ducts, at a distance from the corresponding duct wall.

In a further preferred embodiment in accordance with the invention, the heater includes one or more heat pipes, arranged inside the heater duct or ducts at a distance from the nearest duct wall, for promoting heat transfer from the working medium to the heat-storage material.

Heat pipes are known, for example, from U.S. Pat. Nos. 3,229,759 and 3,402,767. Such a heat pipe is an evaporation/condensation system in which condensate from the condenser is returned to the evaporator through a capillary structure by capillary action (independent of gravity). As a result of the evaporation process, very high heat transport capacities are available.

BRIEF DESCRIPTION OF THE DRAWING

The invention will be described in detail hereinafter with reference to the accompanying diagrammatic drawing which is not to scale.

DESCRIPTION OF THE PREFERRED EMBODIMENT

Figure 1:
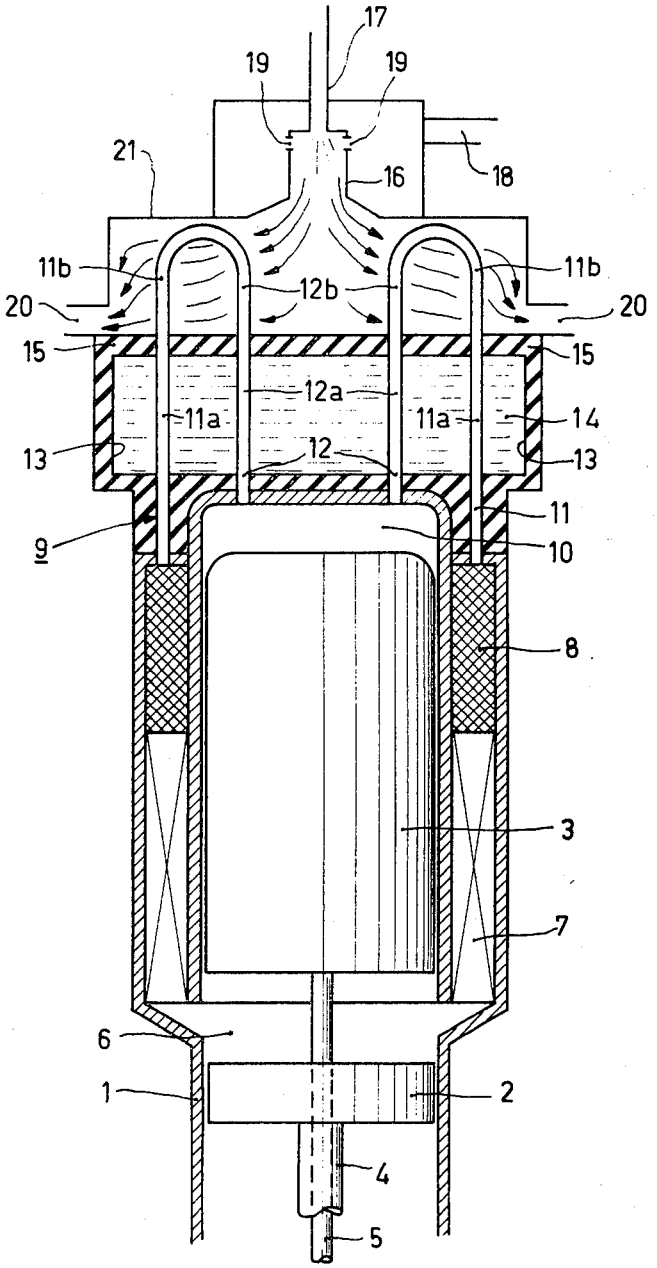
FIGS. 1 and 2 are longitudinal sectional views of the heater and working space parts of hot-gas engines according to the invention, in which the heater duct pipes are partly enveloped by meltable heat-storage material and partly contacted directly by flue gases.

In FIG. 1 a cylinder 1 is shown in which a piston 2 and a displacer 3 are movable. The piston and the displacer are connected, by means of a piston rod 4 and a displacer rod 5, respectively, to a drive not shown. Between the piston 2 and the lower side of the displacer 3 there is a compression space 6 which communicates, via a cooler 7, a regenerator 8 and a heater 9, with an expansion space 10. The heater 9 is formed by an outer ring of pipe ducts 11, whose lower ends communicate with the regenerator 8 while their other ends communicate with an inner ring of pipe duct 12 which in turn communicate with the expansion space 10. For the sake of clarity, only two pipes of each ring are shown.

The lower portions 11*a* and 12*a* of the pipes 11 and 12, respectively, are situated within a reservoir 13 which is filled with a heat-storing material 14, preferably the meltable metal salt LiF. The entire wall surface on the outer side of the reservoir 13 is covered with a layer of heat-insulating material 15.

Above the inner ring of pipes a burner 16 is located, to which fuel can be supplied via an inlet 17, and air can be supplied via an inlet 18 and openings 19, the air having been preheated in a preheater not shown.

Operation of such a hot-gas engine is well known, for example from the U.S. Pat. No. 3,791,136 referred to above.

Heat is supplied to the heater by the burner 16. The flue gases of this burner successively pass the upper portions **12*b* and 11*b* of the pipe ducts 12 and 11, respectively, where heat is given off to the working medium of the engine (for example, hydrogen or helium) which flows to and fro through the heater pipes. The flue gases subsequently leave the engine via openings 20 in the housing 21**.

The heat taken up by the working medium in the heater pipe portions **11*b* and 12*b* is partly given off in the pipe portions 11*a* and 12*a* to the LiF in the reservoir 13**. The LiF melts in due course. The remaining heat is converted into mechanical energy.

If the engine is to supply peak power temporarily, heat can be extracted from the LiF as an auxiliary heat source by the working medium.

Because the reservoir 13 is thermally insulated relative to the flue gases, the LiF exchanges heat directly only with the working medium.

Figure 2:
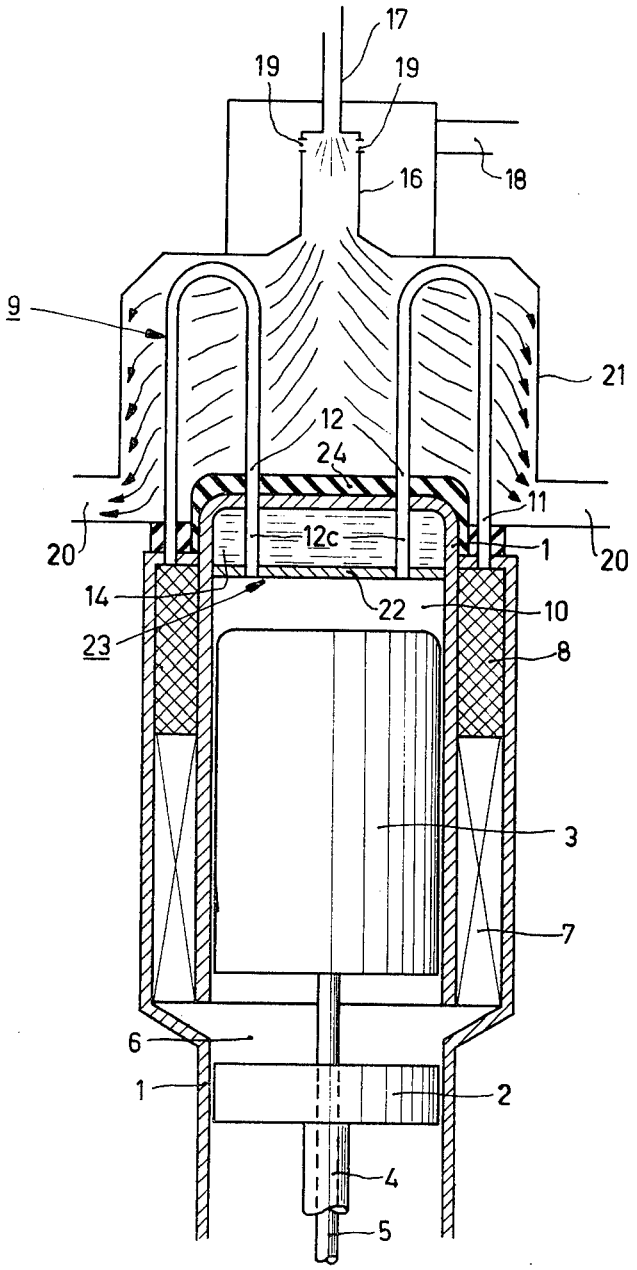

Corresponding reference numerals are used for parts of the hot-gas engine shown in FIG. 2 which correspond to those of the hot-gas engine shown in FIG. 1. In this embodiment the meltable heat-storing material 14 is contained in a reservoir 23 which is bounded by the cylinder 1 and a wall 22. Extended portions **12*c* of the heater ducts 12 pass through the reservoir 23. Thermal insulation of the reservoir 23 relative to the flue gases is provided by a lining 24. Operation is as described with reference to FIG. 1**.

Figure 3:
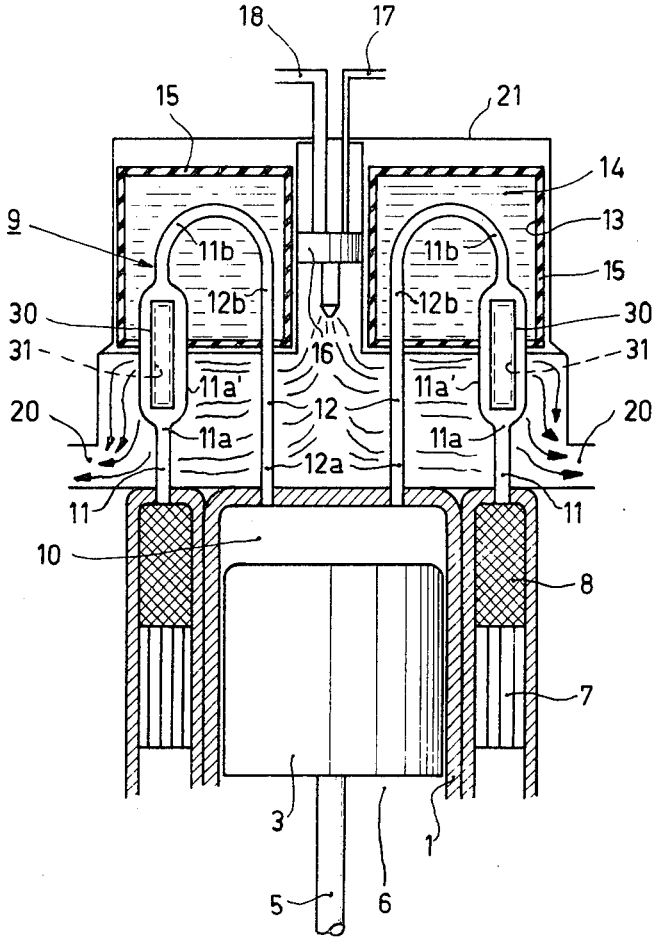
FIG. 3 is a longitudinal sectional view of the corresponding parts of a hot-gas engine having heat pipes arranged inside the heater duct pipes, and an alternative reservoir shape.

In the hot-gas engine shown in FIG. 3, in which the piston is no longer shown, the burner 16 is surrounded by an annular reservoir 13. The upper heater duct portions **11*b* and 12*b* are now arranged in the heat-accumulating material 14 and the lower heater duct portions 11*a* and 12*a* are directly contacted by flue gases. Heat insulation 15** again prevents the direct exchange of heat between the flue gases and the LiF.

The heater ducts 11 are locally widened, the widened portions **11*a* accommodating heat pipes 30 in the flow path of the working medium, located remote from the duct walls, the heat pipes extending from the heater duct portions 11*a* contacted by flue gases into the portions 11*b* passing through the heat-storage material 14. The heat pipe inner walls are lined with a capillary structure 31, for example, a layer of gauze. The heat pipes 30** contain a quantity of sodium.

In practice, the effective heat transport capacity of the working medium is comparatively low in various operating conditions, for example, at a low working medium pressure (low motor power), a low speed (low working medium alternating flow frequency) and also at a small stroke volume if power control is realized by variation of the stroke of the piston.

The heat pipes 30, having a high heat transport capacity by evaporation and condensation of the sodium, provide an increased heat transport from the zone inside the heater duct portions **11*a* to the zone inside the heater portions 11*b***, so that per unit of time additional heat is supplied via the working medium, to the heat-storage material. The charging time of the heat accumulator is thus reduced.

Figure 4:
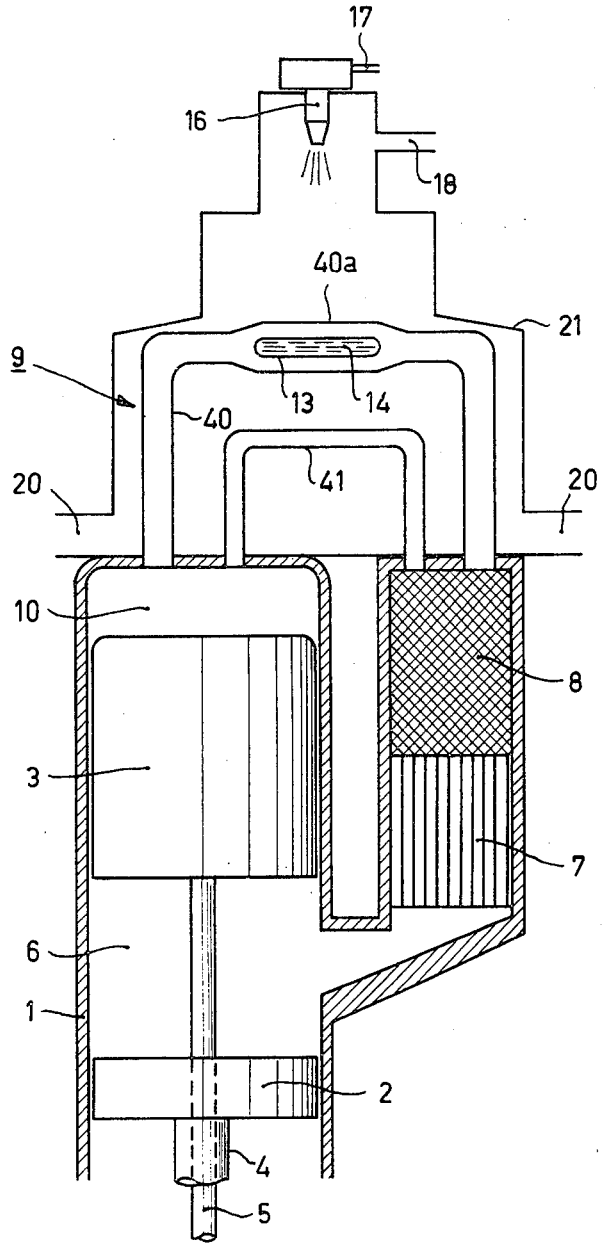
FIG. 4 is a longitudinal sectional view of corresponding parts of a hot-gas engine having reservoirs containing meltable heat-storing material arranged inside the heater duct pipes at a distance from the heater pipe walls.

FIG. 4 depicts an alternative hot-gas engine arrangement, only two of the heater ducts 40 and 41 being shown for the sake of clarity. The reservoir 13 containing heat-storing material 14 is arranged in the widened portion **40*a* of the heater duct 40, remote from the heater pipe wall. The flue gases flowing past the ducts 40 and 41 give off heat to the working medium flowing through the ducts. The working medium flowing through the duct 40 in its turn gives off part of its heat to the material 14**.

Figure 5:
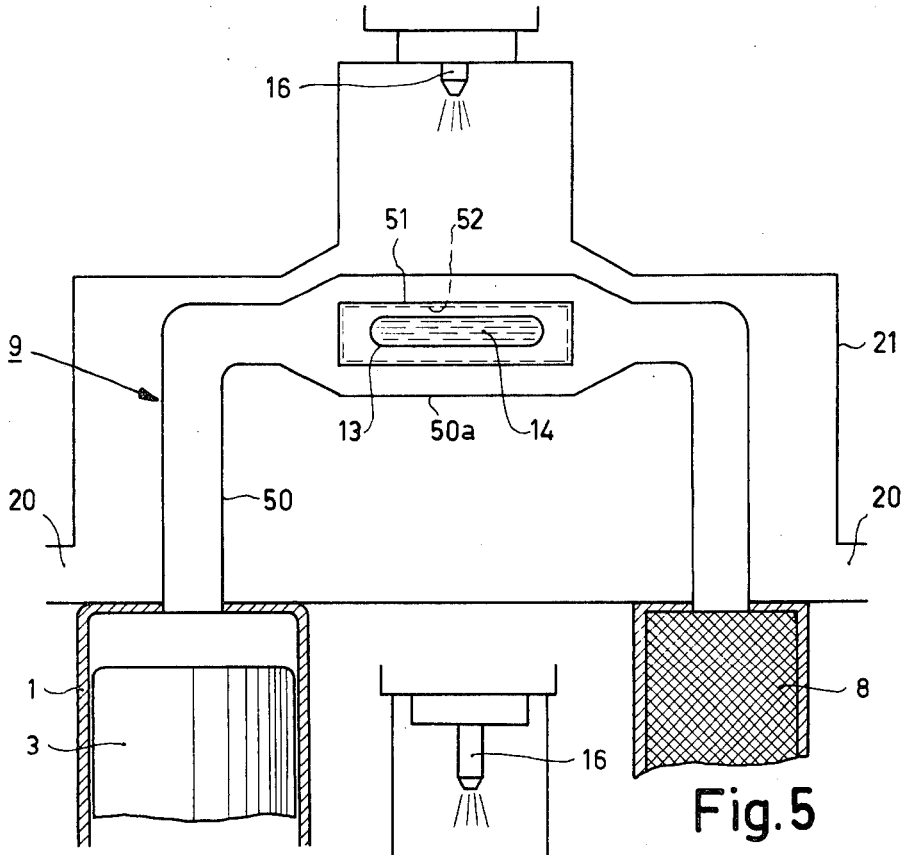
FIGS. 5 and 6 are similar sections of the embodiment of FIG. 4, but having heat pipes also included in the heater ducts, in thermal contact with the reservoirs.

FIG. 5 shows an alternative embodiment of the basic engine of FIG. 4, (only one heater pipe 50 being shown), comprising a widened duct portion **50*a* in which a heat pipe 51 with a capillary structure 52 is arranged at a distance from the heater pipe wall, and encloses the reservoir 13 containing the LiF 14. The heat pipe 51 again contains a quantity of sodium. The sodium takes up heat by evaporation over the comparatively large heat pipe surface from the working medium flowing therealong, and gives off this heat over a comparatively small reservoir wall surface area to the heat-storage material 14** by condensation. The heat pipe then acts as a heat flux transformer.

Figure 6:
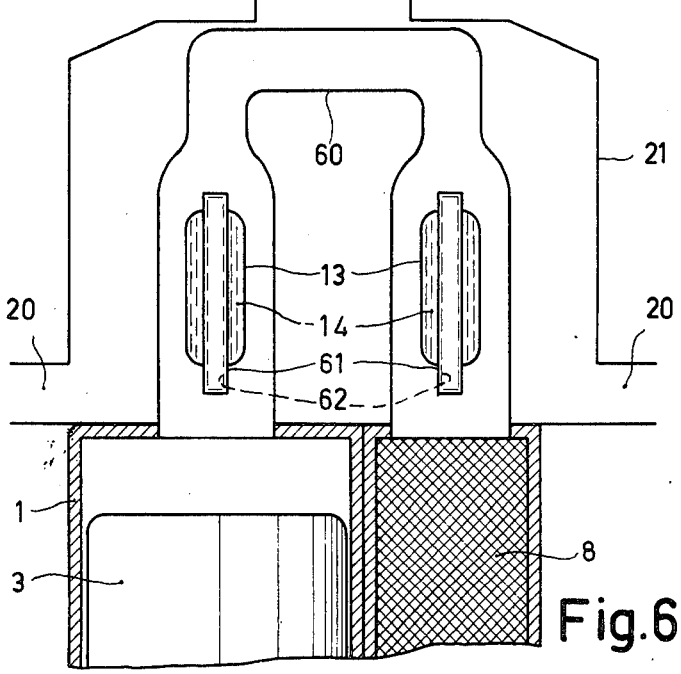

FIG. 6 shows how the heat-exchanging surface area of the reservoirs 13, filled with LiF 14 and arranged inside the duct 60, is artificially increased by means of heat pipes 61 which are passed through the reservoirs and which contain a capillary structure 62 and a quantity of sodium.

Thus, per unit of time more heat is extracted from the working medium and stored in the LiF, and is distributed uniformly over the LiF surface.

It will be clear to those skilled in the art, that besides the heater consisting of pipes, a variety of other heater constructions are feasible.

Even though the figures show hot flue gases as a heat source, use can alternatively be made of heating, for example, by means of a focussing solar collector or isotopes.

We claim:

1. A hot-gas engine comprising a closed working space in which a working medium performs a thermodynamic cycle during operation, and heater means for supplying heat from a heat source to the working medium, the heater means including a number of ducts through which working medium flows during operation and a reservoir containing a meltable material for storing heat originating from the heat source, wherein the reservoir is arranged such that heat is transferred from the source to the meltable material exclusively via the working medium, said ducts passing through the reservoir, and said heater means comprising thermal insulation for insulating the reservoir relative to the heat source.

2. A hot-gas engine as claimed in claim 1, wherein said heater means includes a heat pipe arranged inside a heater duct, remote from the wall of the duct, arranged to promote heat transport from the working medium to the heat storing material.

3. A hot-gas engine comprising a closed working space in which a working medium performs a thermodynamic cycle during operation, and heater means for supplying heat from a heat source to the working medium, the heater means including a number of ducts through which working medium flows during operation and a number of reservoirs containing a meltable material for storing heat originating from the heat source, wherein each reservoir is arranged inside a respective heater duct, remote from the walls of the respective duct, such that heat is transferred from the source to the meltable material exclusively via the working medium.

4. A hot-gas engine as claimed in claim 3, wherein said heater means comprises a heat pipe arranged inside a heater duct, remote from the wall of the duct, arranged to promote heat transport from the working medium to the heat storing material.

5. A hot-gas engine as claimed in claim 4, wherein at least one reservoir is enclosed within said heat pipe.

6. A hot-gas engine as claimed in claim 4, wherein said heat pipe passes through said reservoir.

7. A hot-gas engine having a closed working space in which a working medium performs a thermodynamic cycle during operation, said working space including a first space of variable volume, a second space of variable volume, and a number of ducts having respective ends communicating with said first and second spaces respectively, through which ducts working medium flows back and forth during operation; heater means for supplying heat from a heat source to the working medium by supplying heat to said ducts; and a reservoir containing a meltable material for storing heat originating from the heat source, wherein the reservoir is arranged such that heat is transferred from the source to the meltable material exclusively through the working medium.

8. A hot-gas engine as claimed in claim 7, wherein said means for supplying heat includes means for flowing hot flue gases around said ducts.

9. A hot-gas engine as claimed in claim 8, wherein said ducts pass through the reservoir, a portion of said ducts extending beyond the reservoir being exposed to the hot flue gases, and said heater means comprises thermal insulation disposed between the reservoir and the hot flue gases.

* * * * *